US008447208B2

(12) United States Patent
Fujita et al.

(10) Patent No.: US 8,447,208 B2
(45) Date of Patent: May 21, 2013

(54) IMAGE FORMING APPARATUS

(75) Inventors: Keisuke Fujita, Numazu (JP); Ken Murooka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/455,428

(22) Filed: Apr. 25, 2012

(65) Prior Publication Data

US 2012/0224886 A1 Sep. 6, 2012

Related U.S. Application Data

(62) Division of application No. 12/832,340, filed on Jul. 8, 2010, now Pat. No. 8,190,057.

(30) Foreign Application Priority Data

Jul. 14, 2009 (JP) ..... 2009-165907

(51) Int. Cl.
*G03G 21/18* (2006.01)
*G03G 15/00* (2006.01)
*G03G 15/20* (2006.01)

(52) U.S. Cl.
USPC ..... 399/110; 399/111; 399/122

(58) Field of Classification Search
USPC ..... 399/110, 111, 122, 124, 125
See application file for complete search history.

(56) References Cited

U.S. PATENT DOCUMENTS 5,440,373 A 8/1995 Deki et al.
5,797,068 A 8/1998 Otsuki et al.
5,953,561 A 9/1999 Tashiro et al.
5,956,547 A 9/1999 Kamei et al.
7,031,637 B2 4/2006 Fujita
7,596,339 B2 9/2009 Kawase et al.
7,742,722 B2 6/2010 Shiga et al.
7,778,567 B2 8/2010 Igarashi et al.

FOREIGN PATENT DOCUMENTS

JP 06-110261 A 4/1994
JP 2000-298383 A 10/2000
JP 2000-347549 A 12/2000
JP 2005-070480 A 3/2005

OTHER PUBLICATIONS

Machine translation of JP 2000-347549 A dated Sep. 25, 2012.*

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a main assembly; a cartridge for forming a toner image on a sheet material; a fixing unit for fixing the toner image on the sheet material; and an opening for exposing an inside of the main assembly. The fixing unit and the cartridge are mountable into the main assembly and are disposed side by side. When the fixing unit and the cartridge are mounted or demounted, the fixing unit passes through the opening, and the cartridge passes through a space in which the fixing unit is to be mounted and passes through the opening. When the fixing unit and the cartridge at the time of passing through the opening are projected onto a surface perpendicular to a mounting and demounting direction, a contour of a projected area of the cartridge is at least partly inside a contour of a projected area of the fixing device, and the cartridge passes through the inside of the contour of the projected area of the fixing device when passing through the opening.

10 Claims, 7 Drawing Sheets

POSITION E

IMAGE FORMING APPARATUS

CROSS REFERENCE TO RELATED APPLICATION

This application is a division of U.S. patent application Ser. No. 12/832,340, filed Jul. 8, 2010. The entire disclosure of the earlier application is hereby incorporated by reference herein.

FIELD OF THE INVENTION AND RELATED ART

The present invention relates to an image forming apparatus for forming an image on a sheet material.

In the image forming apparatus, a process cartridge for forming the image on the sheet material fed in a conveyance direction and a fixing unit for fixing the image on the sheet material on a downstream side of the process cartridge with respect to the conveyance direction of the sheet material have been conventionally provided. The process cartridge includes a photosensitive drum as an image bearing member, a charger and a developing device which are integrally assembled into a cartridge and is detachably mountable to a main assembly of the image forming apparatus (apparatus main assembly), thus facilitating maintenance such as toner supply or jam clearance. Japanese Laid-Open Patent Application (JP-A) 2005-70480 discloses a constitution in which an openable front cover is provided on a casing of the image forming apparatus and inside the front cover, a part of a sheet material conveying system and a part of a fixing unit are mounted. According to the constitution, the conveying system and the fixing unit are opened outward together with the front cover by opening the front cover, the process cartridge can be exposed and therefore mounting and demounting of the process cartridge can be performed easily.

In recent years, a demand for downsizing of the image forming apparatus has been increased. In order to meet the demand, the image forming apparatus in which a conveying path of the sheet material is formed with respect to a substantially horizontal direction and the process cartridge and the fixing unit are disposed substantially horizontally has been proposed. In this image forming apparatus, a height dimension of the image forming apparatus can be suppressed, so that the image forming apparatus can be downsized. FIG. 7(*a*) is a schematic illustration of the image forming apparatus having such a constitution. In the image forming apparatus shown in FIG. 7(*a*), in a sheet material conveying path from a sheet feeding cassette 40 to a sheet discharge roller through a sheet feeding roller 60 and a conveying roller 80, a conveying path section thereof from a process cartridge 410 to a fixing unit 420 is formed in the substantially horizontal direction. As a result, the process cartridge 410 and the fixing unit 420 are disposed substantially horizontally, so that it is possible to suppress the height dimension of the image forming apparatus. Incidentally, the image forming apparatus further includes a photosensitive drum 100, a developing device 110, and an exposure device 90 for scanning-exposing the surface of the photosensitive drum 100 to laser light. Further, according to the above constitution, supply of the sheet material into the sheet feeding cassette 40 and discharge of the sheet material on which the image has been formed can be performed from one direction by a discharge roller 130 (a rightward direction in FIG. 7(*a*)), so that usability is also improved.

However, such a small-sized image forming apparatus in which the process cartridge and the fixing unit are disposed side by side to suppress the height dimension is accompanied with the following problem. In the case where the above constitution is applied to the small-sized image forming apparatus with the suppressed height dimension, even when the front cover 401 is opened during a maintenance operation such as exchange of the process cartridge 410 or the jam clearance, the process cartridge cannot be sufficiently exposed. This is because the height dimension of the front cover is small and therefore it is difficult to ensure a stroke in which the fixing unit 420 can be retracted for permitting sufficient exposure of the process cartridge 410 by an opening and closing operation of the front cover 401.

Thus, particularly in the small-sized image forming apparatus as described above, in the case where a constitution in which the fixing unit is fixed and an openable member and is moved in order to permit mounting and demounting of the cartridge is employed, the fixing unit cannot be sufficiently retracted. Further, the image forming apparatus includes an opening which exposes the inside of the image forming apparatus and through which the fixing unit and the cartridge pass. However, in the case where an area in which the fixing unit passes and an area in which the cartridge passes are deviated at an opening surface of the opening, an area of the opening surface is increased. For this reason, the image forming apparatus is increased in size or there is need to enhance strength of a frame or the like in order to ensure the strength of the image forming apparatus, thus resulting in an increase in cost.

SUMMARY OF THE INVENTION

A principal object of the present invention is to provide an image forming apparatus, including a fixing unit and a cartridge which are detachably mountable to a main assembly thereof, capable of suppressing an area of an opening surface through which the fixing unit and the cartridge are mounted in and demounted from the main assembly.

and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. However, it should be understood that dimensions, materials, shapes, relative positions, and the like of constituent elements or means of an image forming apparatus according to the present invention are not limited to those described in the following embodiments unless otherwise specified.

First Embodiment

Figure 1:
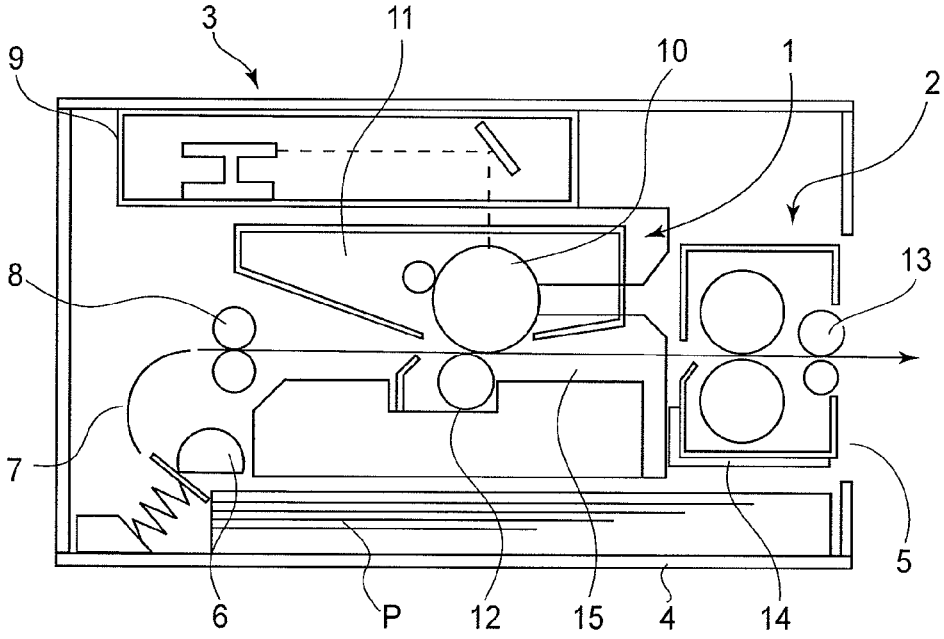
FIG. 1 and FIGS. 2(*a*) and 2(*b*) are schematic illustrations of an image forming apparatus according to First Embodiment.
Figure 2:
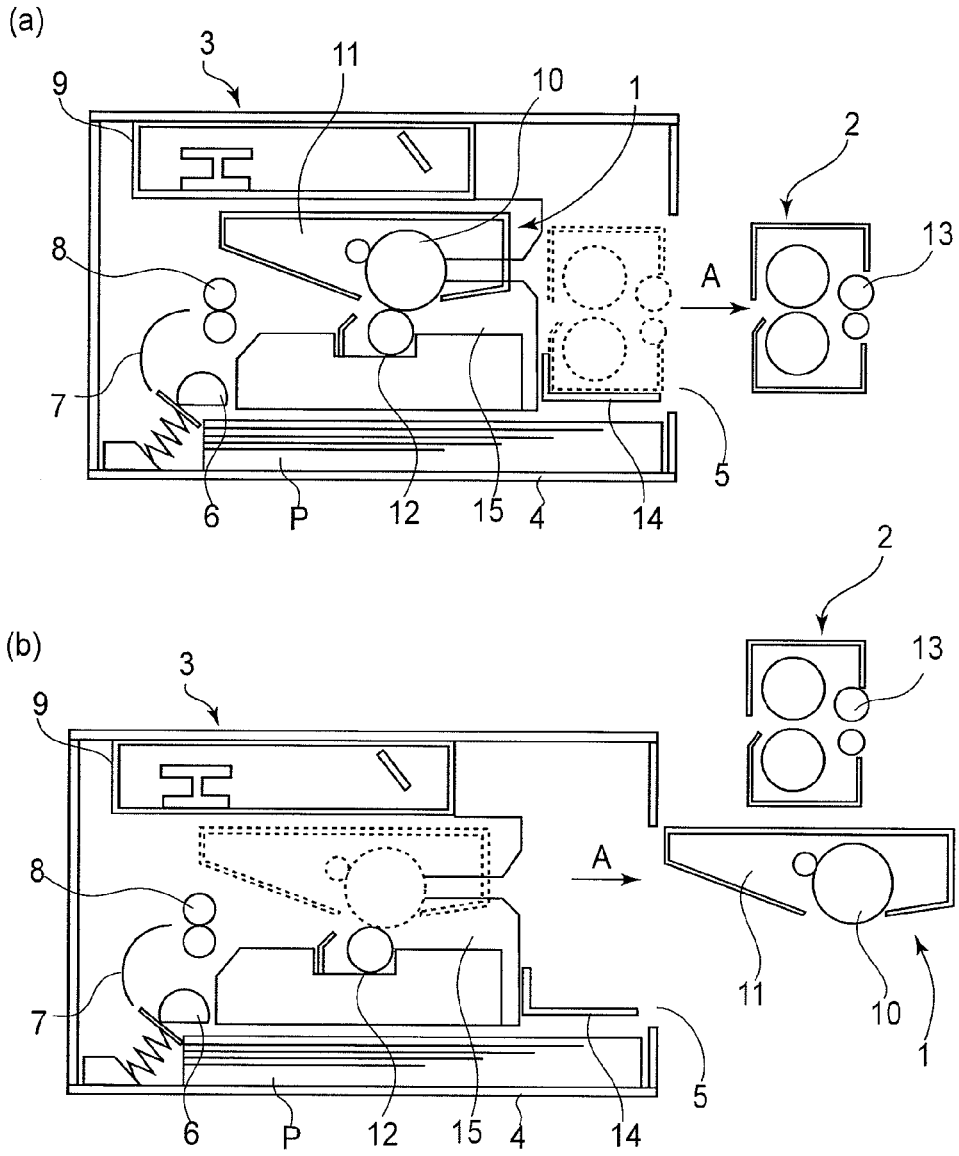

With reference to FIGS. 1, 2(*a*) and 2(*b*), the image forming apparatus in this embodiment according to the present invention will be described. FIG. 1 is a schematic sectional illustration of the image forming apparatus in this embodiment, and FIGS. 2(*a*) and 2(*b*) are schematic illustrations showing a state in which a fixing unit is demounted from the image forming apparatus and a state in which the fixing unit and a cartridge are demounted from the image forming apparatus, respectively. In this embodiment, a laser beam printer of an electrophotographic type will be described but the image forming apparatus of the present invention is not limited thereto.

(General Structure of Image Forming Apparatus)

As shown in FIG. 1, an image forming apparatus 3 includes a process cartridge 1 and a fixing unit 2 which are provided and disposed side by side along a sheet material conveying path with respect to a substantially horizontal direction.

The process cartridge 1 includes a photosensitive drum 10 as an image bearing member, a charging member (not shown) for electrically charging the surface of the photosensitive drum 10, and a developing device 11 containing toner, which are integrally provided. Further, above the process cartridge 1, an exposure device 9 for emitting laser light to scanning-expose the surface of the photosensitive drum 10 is provided. Further, a transfer roller (transfer member) 12 is provided at a position in which the transfer roller 12 is contactable to the photosensitive drum 10 and opposes the photosensitive drum 10 while a sheet material conveying path intervenes between the transfer roller 12 and the photosensitive drum 10. A transfer nip is created between the transfer roller 12 and the photosensitive drum 10.

When the image is formed on the sheet material, first, the surface of the photosensitive drum 10 is uniformly charged by the action of the charging member and then is exposed to the laser light emitted from the exposure device 9, so that an electrostatic latent image is formed on the surface of the photosensitive drum 10. To the electrostatic latent image, the toner is supplied from the developing device 11, so that the electrostatic latent image is developed into a toner image. Thereafter, a sheet material P stacked in a sheet feeding cassette 4 is fed one by one by a sheet feeding roller 6, so that the sheet material P passes through a conveying path 7 and is conveyed to the transfer nip by a conveying roller 8. In the transfer nip, a transfer voltage is applied to the transfer roller 12 by an unshown voltage application means, so that the toner image is electrostatically transferred from the photosensitive drum 10 onto the sheet material P.

The sheet material P on which the toner image is transferred passes through the conveying path formed with respect to a substantially horizontal direction and is conveyed to the fixing unit 2, in which the toner image is heated and pressed and thus is fixed on the sheet material P. Thereafter, the sheet material P is discharged to the outside of the apparatus main assembly. In the fixing unit 2, a fixing device constituted by a heating roller and a pressing roller and a discharge roller 13 for discharging the image-fixed sheet material P to the outside of the apparatus main assembly are provided.

In this embodiment, the sheet feeding cassette 4 is constituted so as to detachably mountable to the apparatus main assembly, so that the sheet feeding cassette 4 can be demount in a rightward direction in FIG. 1. Further, the sheet material P is conveyed along a substantially U-shaped conveying path and is discharged rightward to the outside of the apparatus main assembly as shown in FIG. 1. That is, a sheet material supplying operation and a discharging operation of the image-formed sheet material P can be performed from the same direction of the image forming apparatus 3, i.e., from a side on which the sheet material P is to be discharged, so that usability is improved. Further, a section of the sheet material P conveying path from the transfer nip to the fixing unit 2 is formed with respect to the substantially horizontal direction and along the section, the process cartridge 1 and the fixing unit 2 are disposed with respect to the substantially horizontal direction, so that a height dimension of the image forming apparatus 3 can be suppressed. Incidentally, in the following, a surface on a side where the image-formed sheet material in the image forming apparatus 3 is discharged (on the right side in FIG. 1) is referred to as a "front surface".

(Constitution for Permitting Access to Process Cartridge from Front Surface of Image Forming Apparatus)

With reference to FIGS. 2(*a*) and 2(*b*), a constitution for permitting access to the process cartridge 1 from the front surface of the image forming apparatus 3 will be described.

As shown in FIGS. 2(*a*) and 2(*b*), in the image forming apparatus 3 in this embodiment, a fixing guide (first guide portion) 14 for guiding mounting and demounting of the fixing unit 2 and a cartridge guide (second guide portion) 15 for guiding mounting and demounting of the process cartridge 1 are provided. Each of the fixing guide 14 and the cartridge guide 15 is provided at both end portions with respect to a shaft (axis) direction of the photosensitive drum 10 (a direction perpendicular to the drawing sheet of FIGS. 2(*a*) and 2(*b*)). The fixing guide 14 guides the fixing unit 2 with respect to a mounting and demounting direction while contacting a casing of the fixing unit 2 at the both end portions with respect to the shaft direction of the photosensitive drum 10. Further, the cartridge guide 15 guides the process cartridge 1 with respect to the mounting and demounting direction while contacting the casing of the process cartridge at the both end portions with respect to the shaft direction of the photosensitive drum 10.

In the case where a user accesses to the process cartridge 1 in order to perform jam clearance, exchange of the process cartridge 1, and the like, first, the fixing unit 2 is demounted in a direction indicated by an arrow A in FIG. 2(*a*) (a direction in which the sheet material is to be discharged) along the fixing guide 14 through an opening 5 provided at the front surface of the image forming apparatus 3. The arrow A direction means a direction in which the fixing unit 2 and the process cartridge 1 are arranged side by side and coincides with the sheet material discharging direction in this embodiment. The fixing unit 2 is fixed in the image forming apparatus main assembly by an unshown urging member. Further, the casing of the fixing unit 2 on the front surface side is constituted by a two-layer mold. On the front surface side, an openable member for covering and uncovering the opening 5 is not provided.

Next, by utilizing a space created by demounting the fixing unit 2, the process cartridge 1 is demounted in the arrow A direction along the cartridge guide (FIG. 2(*b*)). The process cartridge 1 is also fixed in the image forming apparatus main assembly by an urging member similarly as in the case of the fixing unit 2.

By performing the above-described demounting operation, the user can easily access to the process cartridge 1 from the front surface of the image forming apparatus 3. Incidentally, when the process cartridge 1 and the fixing unit 2 are mounted in the image forming apparatus main assembly, these members can be mounted by reversing the demounting operation. That is, the cartridge 1 is mounted along the cartridge guide 15 by utilizing the space created by demounting the fixing unit 2 and then the fixing unit 2 is mounted along the fixing guide 14.

Further, in this embodiment, the transfer roller 12 is disposed offset on an upstream side of the photosensitive drum 1 with respect to a conveyance direction of the sheet material P. That is, the shaft of the transfer roller 12 is disposed upstream of the shaft of the photosensitive drum 10 with respect to a demounting direction of the process cartridge 1. Therefore, the transfer nip is located upstream of the shaft of the photosensitive drum 10 with respect to the demounting direction of the process cartridge 1. For this reason, there is no possibility that the photosensitive drum 10 and the transfer roller interfere with each other when the process cartridge 1 is demounted. That is, there is no possibility of a lowering in operativity during the mounting and demounting of the process cartridge 1 due to the contact between the photosensitive drum 10 and the transfer roller 12, so that friction between the photosensitive drum 10 and the transfer roller 12 is also suppressed.

Figure 7:
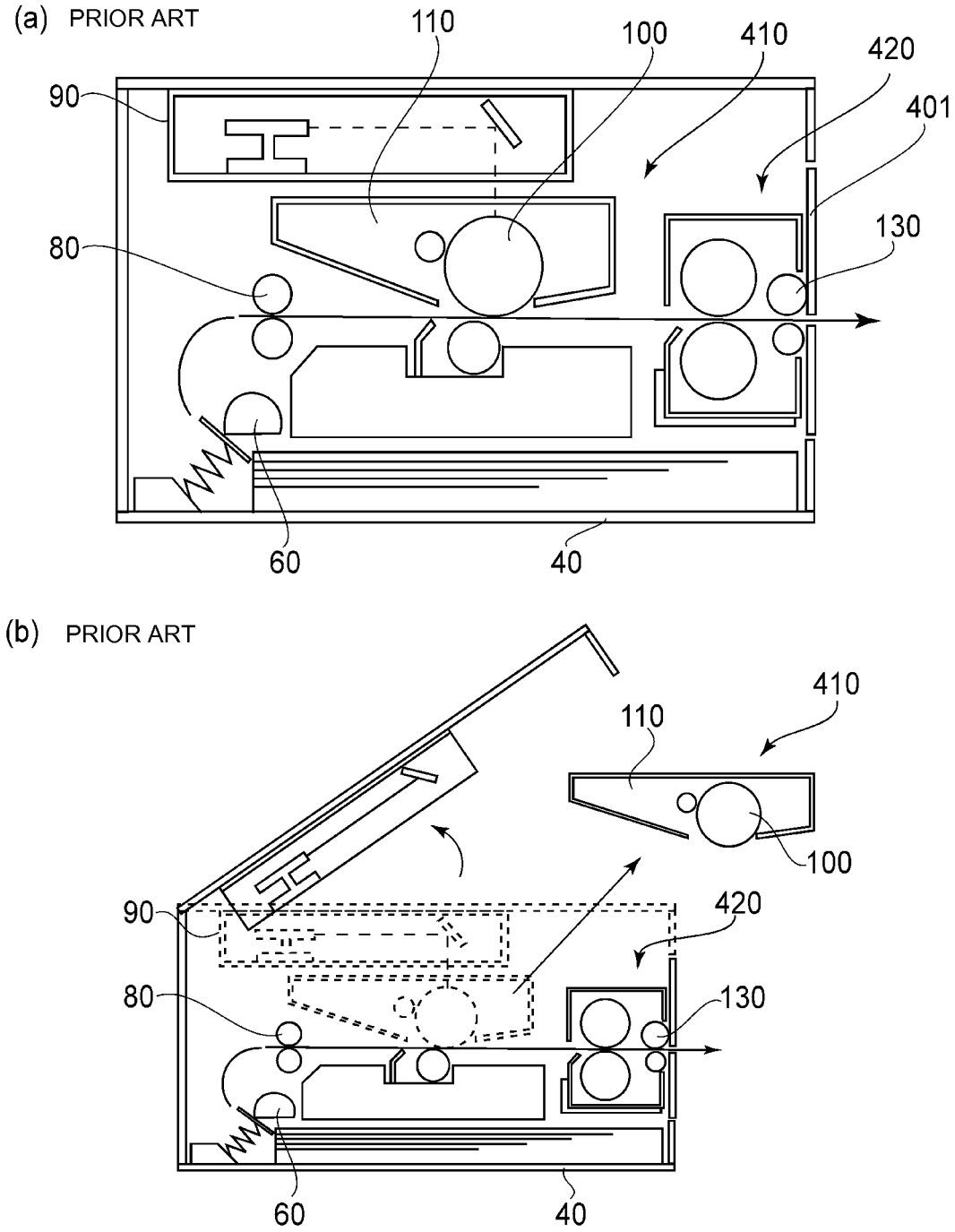
FIGS. 7(*a*) and 7(*b*) are schematic illustrations of a conventional image forming apparatus.

Further, in the conventional image forming apparatus shown in FIG. 7(*b*), the exposure device 90 is provided inside an openable upper surface of the image forming apparatus, so that the exposure device 90 is moved every opening and closing operation of the upper surface. For this reason, positioning accuracy of the exposure device 90 relative to the photosensitive drum 100 is lowered. Further, there is a possibility that a position of optical parts inside the exposure device 90 by impact during movement of the exposure device 90. Further, in the case where a facsimile machine, an image reader, or the like is additionally provided at the upper surface of the image forming apparatus, there is need to employ a constitution in which the image forming apparatus upper surface is openable and rigid while withstanding a weight of the additional devices. As a result, a production cost is increased.

In this embodiment, in the image forming apparatus 3, the fixing guide 14 and the cartridge guide 15 are provided, so that the mounting and demounting of the fixing unit 2 and the process cartridge 1 can be performed through the front surface of the image forming apparatus 3. Thus, the mounting and demounting of the process cartridge 1 can be performed by utilizing the space for permitting the mounting and demounting of the fixing unit 2, so that in order to mount and demount the process cartridge 1, there is no need to employ a constitution in which the upper surface of the image forming apparatus 3 is openable or a constitution in which the exposure device 9 is moved. That is, the conventional problem caused by access to the process cartridge from the upper surface can be solved while suppressing the height dimension of the image forming apparatus 3.

Further, in this embodiment, when the fixing unit 2 and the process cartridge 1 are projected onto the front surface of the image forming apparatus 3, i.e., when the fixing unit 2 and the process cartridge 1 are viewed from a direction normal to the front surface (the mounting and demounting direction), a projected area of the fixing unit 2 is larger than that of the process cartridge 1. Further, the process cartridge 1 can be demounted through the projected area of the fixing unit 2. In other words, a contour of the projected area of the process cartridge 1 is at least partly inside that of the fixing unit 2. Further, when the process cartridge 1 is mounted in and demounted from the apparatus main assembly, the process cartridge 1 is configured to pass through the inside of the contour of the projected area of the fixing unit 2 and the opening 5 is configured to have a minimum necessary area for the mounting and demounting of the fixing unit 2.

Thus, by configuring the opening 5 to have the minimum necessary area for the mounting and demounting of the fixing unit 2, the area of an opening surface of the opening 5 for permitting the mounting and demounting of the fixing unit 2 and the process cartridge 1 can be suppressed, so that it is possible to suppress increases in size of the image forming apparatus and in cost in order to ensure a strength of the image forming apparatus. Further, in the case where an operating panel or the like is disposed at the front surface, an area in which the operating panel or the like is disposed can be easily ensured and disposition latitude thereof is also enhanced. Incidentally, the minimum necessary area for the mounting and demounting of the fixing unit 2 means an area in which the opening 5 has the contour which is a size larger than the contour of the projected area of the fixing unit 2 in consideration of clearance during the mounting and demounting of the fixing unit 2. When the opening 5 has the contour of the projected area which is larger than that of the fixing unit 2 by about 3 mm to about 5 mm, it is possible to decrease a possibility that user's fingers are caught in the clearance between the contours of the fixing unit 2 and the opening 5 and a possibility that dust enters the inside of the image forming apparatus while decreasing a degree of the interference of the fixing unit 2 with the apparatus main assembly during the mounting and demounting of the fixing unit 2.

Further, in this embodiment, the process cartridge 1 is described as the cartridge but the cartridge in the present invention may also be any cartridge such as a cartridge for supplying only the toner so long as the cartridge is mounted in the apparatus main assembly and is actuated so as to form the toner image on the sheet material. Further, it is also possible to provide an openable member for covering and uncovering the opening 5.

As described above, according to this embodiment, with respect to the image forming apparatus such that the fixing unit and the cartridge are mountable in and demountable from the apparatus main assembly, it is possible to provide the image forming apparatus in which the area of the opening surface for permitting the mounting and demounting of the fixing unit and the cartridge is suppressed.

Second Embodiment

Figure 3:
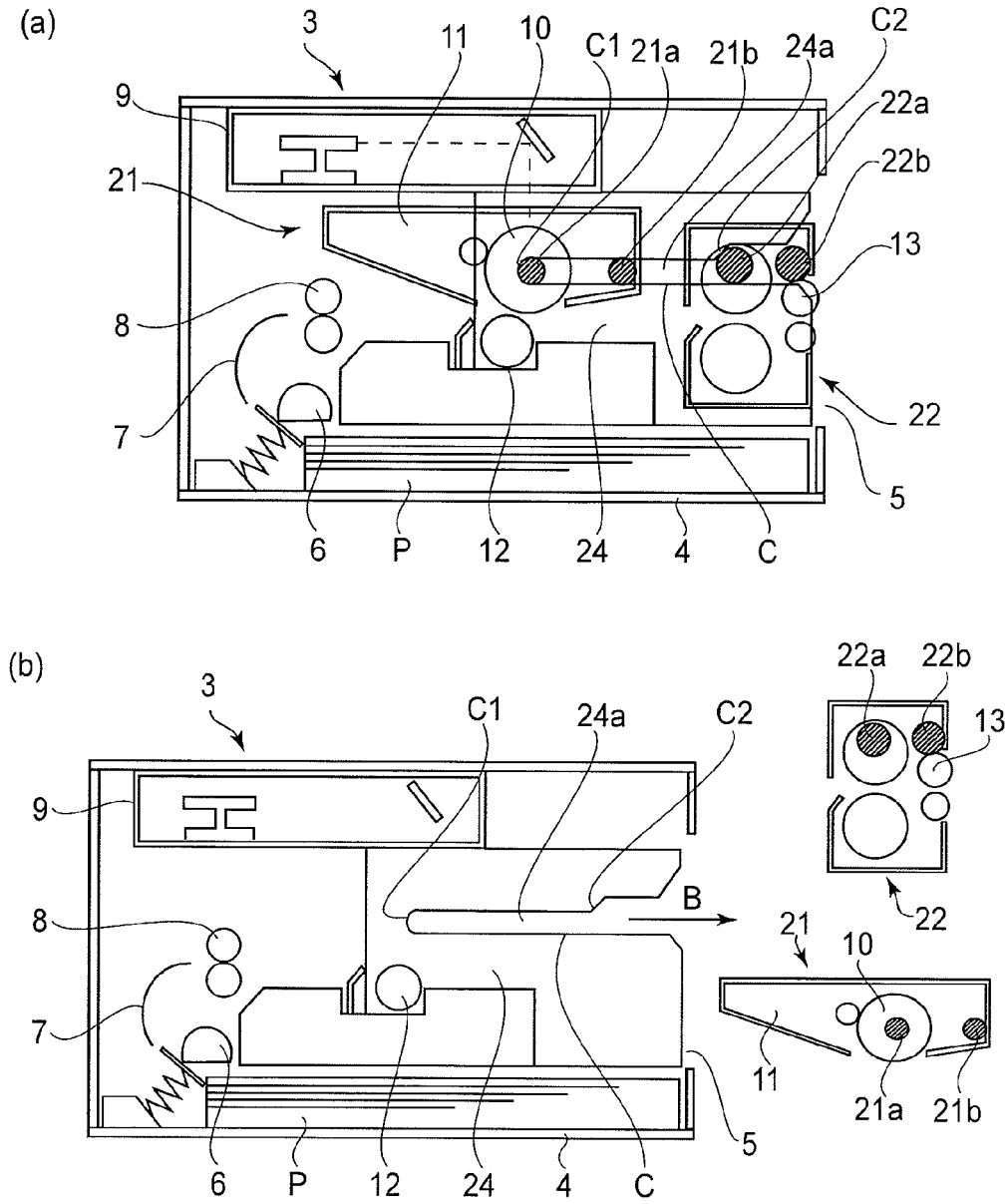
FIGS. 3(*a*) and 3(*b*) are schematic illustrations of an image forming apparatus according to Second Embodiment.

With reference to FIGS. 3(*a*) and 3(*b*), the image forming apparatus in this embodiment according to the present invention will be described. FIGS. 3(*a*) and 3(*b*) are schematic sectional illustrations of the image forming apparatus 3 in this embodiment, in which FIG. 3(*a*) shows a state in which a fixing unit 22 and a process cartridge 21 are mounted and FIG. 3(*b*) shows a state in which the fixing unit 22 and the process cartridge 21 are demounted. Incidentally, constituent members or portions identical to those in First Embodiment are represented by the same reference numerals or symbols, thus being omitted from description.

In First Embodiment, the constitution in which the guide portions are provided correspondingly to the fixing unit and the process cartridge is employed but in this embodiment, a holding member 24 for integrally holding the fixing unit 22 and the process cartridge 21 is provided.

The process cartridge 21 is provided with bosses 21*a* and 21*b* at side surfaces of the casing thereof, and the fixing unit 22 is provided with bosses 22*a* and 22*b* at side surfaces of the casing thereof. These bosses 21*a*, 21*b*, 22*a* and 22*b* are provided at both end portions with respect to the shaft direction of the photosensitive drum 10 (the direction perpendicular to the drawing sheet of FIGS. 3(*a*) and 3(*b*)). Further, the holding member 24 is fixed in the image forming apparatus 3 and is provided with a guiding groove 24*a* having a surface C extending in the substantially horizontal direction. The holding member 24 is provided at both end portions with respect to the shaft direction of the photosensitive drum 10. In a state in which the fixing unit 22 and the process cartridge 21 are mounted in the image forming apparatus 3, the bosses 21*a*, 21*b*, 22*a* and 22*b* are engaged in the guiding groove 24*a* and are supported on the surface C, so that the positions of the fixing unit 22 and the process cartridge 21 with respect to the height direction are determined.

Further, the process cartridge 21 is abutted against a surface C1 and the fixing unit 22 is abutted against a surface C2 with respect to the horizontal direction, so that the positions of the process cartridge 21 and the fixing unit 22 with respect to the horizontal direction are determined.

When the user accesses to the process cartridge 21, as shown in FIG. 3(*b*), the fixing unit 22 and the process cartridge 21 are demounted in a direction indicated by an arrow B while the bosses 21*a*, 21*b*, 22*a* and 22*b* are moved along the surface C. As a result, the user can access to the process cartridge 21 from the front surface of the image forming apparatus. Thus, the mounting and demounting of the process cartridge 2 can be performed by utilizing the space for permitting the mounting and demounting of the fixing unit 22, so that in order to mount and demount the process cartridge 21, there is no need to employ a constitution in which the upper surface of the image forming apparatus 3 is openable or a constitution in which the exposure device 9 is moved. That is, the conventional problem caused by access to the process cartridge from the upper surface can be solved while suppressing the height dimension of the image forming apparatus 3.

Similarly as in First Embodiment, in this embodiment, when the fixing unit 22 and the process cartridge 21 are projected onto the front surface of the image forming apparatus 3, i.e., when the fixing unit 22 and the process cartridge 21 are viewed from a direction normal to the front surface (the mounting and demounting direction), a projected area of the fixing unit 22 is larger than that of the process cartridge 21. Further, the process cartridge 21 can be demounted through the projected area of the fixing unit 22. In other words, a contour of the projected area of the process cartridge 21 is inside that of the fixing unit 22. Further, when the process cartridge 21 is mounted in and demounted from the apparatus main assembly, the process cartridge 21 is configured to pass through the inside of the contour of the projected area of the fixing unit 22 and the opening 5 is configured to have a minimum necessary area for the mounting and demounting of the fixing unit 22.

Thus, by configuring the opening 5 to have the minimum necessary area for the mounting and demounting of the fixing unit 22, the area of an opening surface of the opening 5 for permitting the mounting and demounting of the fixing unit 22 and the process cartridge 21 can be suppressed, so that it is possible to suppress increases in size of the image forming apparatus and in cost in order to ensure a strength of the image forming apparatus. Further, in the case where an operating panel or the like is disposed at the front surface, an area in which the operating panel or the like is disposed can be easily ensured and disposition latitude thereof is also enhanced.

Further, in this embodiment, the fixing unit 22 and the process cartridge 21 are positioned in the image forming apparatus by the common holding member 24, so that accuracy of alignment between the fixing unit 22 and the process cartridge 21 with respect to the height and horizontal directions of the image forming apparatus is improved. That is, a relative position between the fixing unit 22 and the process cartridge 21 with respect to the height and horizontal directions of the image forming apparatus is determined with reliability. Therefore, the sheet material P can be conveyed satisfactory, so than an image quality can be stabilized. Incidentally, in this embodiment, the fixing unit 22 and the process cartridge 21 are supported in the same surface C but may also be supported by different surfaces so long as the common holding member 24 can be used. Further, the holding member 24 can be said that it is a member prepared by integrally forming the fixing guide 14 and the cartridge guide 15 which are described in First Embodiment. For this reason, in this embodiment, there is no need to separately mount the fixing guide 14 and the cartridge guide 15 in the apparatus main assembly, so that an assembling operation is facilitated.

As described above, according to this embodiment, with respect to the image forming apparatus such that the fixing unit and the cartridge are mountable in and demountable from the apparatus main assembly, it is possible to provide the image forming apparatus in which the area of the opening surface for permitting the mounting and demounting of the fixing unit and the cartridge is suppressed.

Third Embodiment

Figure 4:
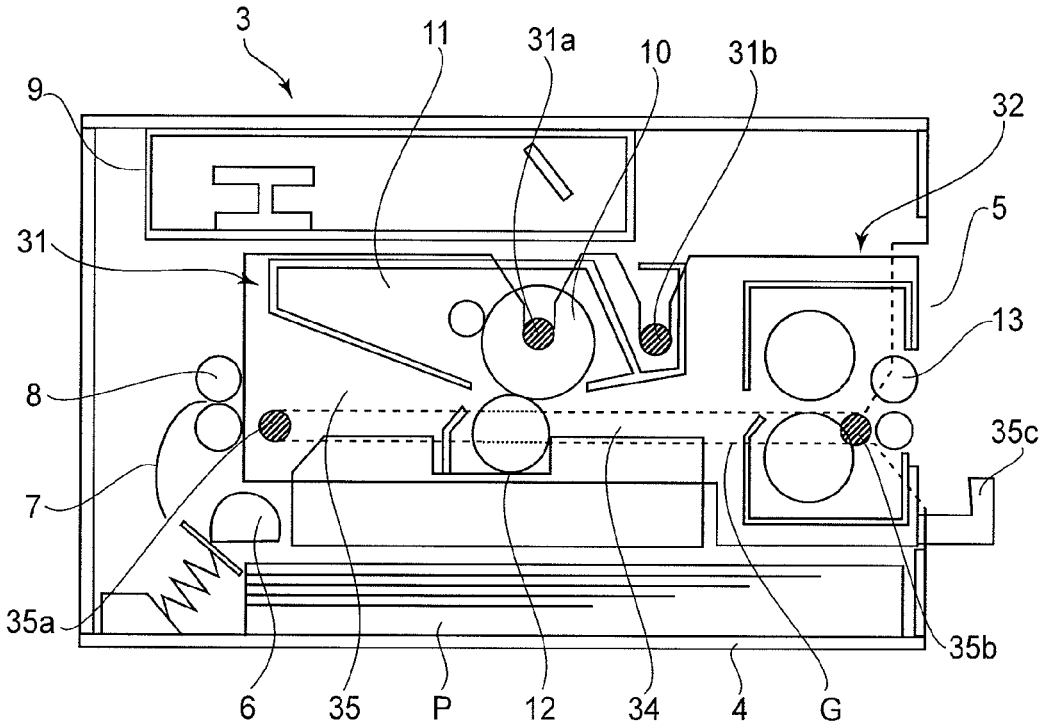
FIG. 4 is a schematic illustration of an image forming apparatus according to third Embodiment.
Figure 5:
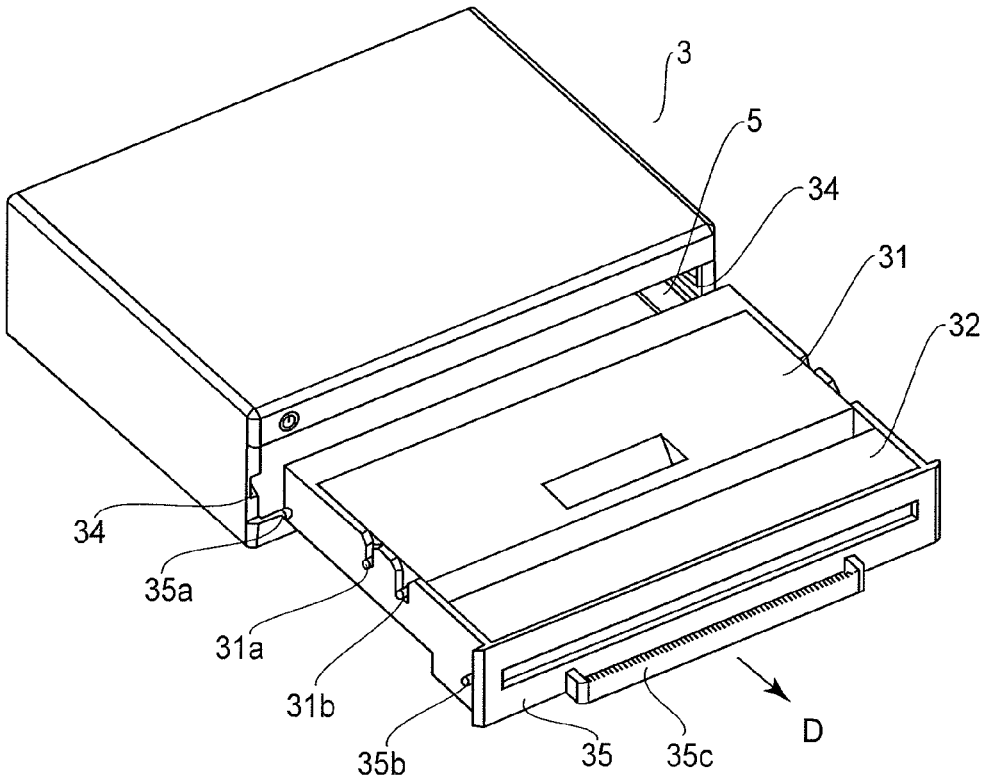
FIG. 5 is a schematic perspective view of a tray in Third Embodiment.
Figure 6:
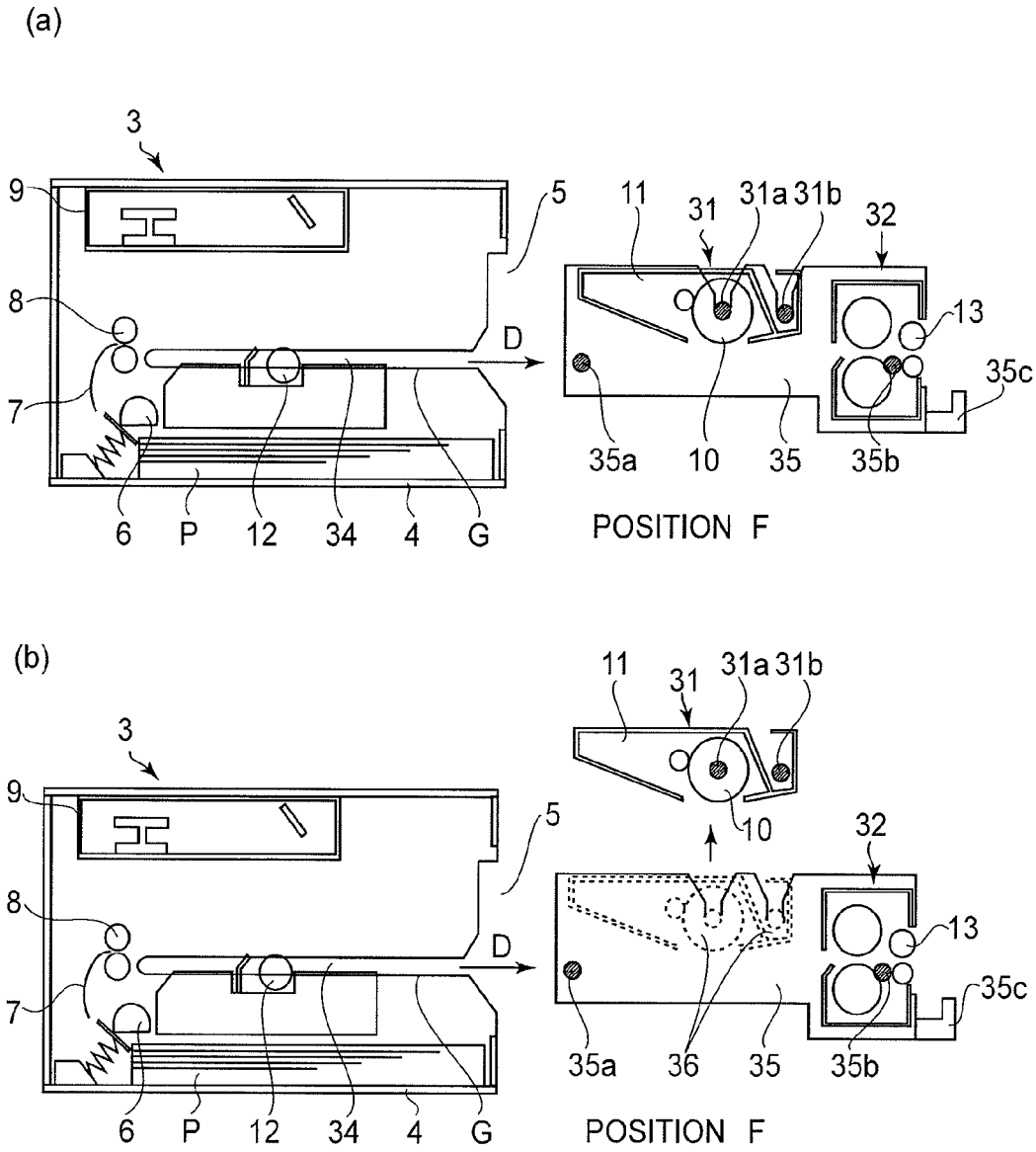
FIGS. 6(*a*) and 6(*b*) are schematic illustrations of the image forming apparatus according to Third Embodiment.

With reference to FIGS. 4, 5, 6(*a*) and 6(*b*), the image forming apparatus in this embodiment according to the present invention will be described. FIG. 4 is a schematic sectional illustration of the image forming apparatus in this embodiment, and FIG. 5 is a schematic perspective view of a tray 35 in this embodiment. FIGS. 6(*a*) and 6(*b*) are schematic illustrations each showing a state in which a fixing unit 32 and a cartridge 31 are demounted from the image forming apparatus. Incidentally, constituent members or portions identical to those in First and Second Embodiments are represented by the same reference numerals or symbols, thus being omitted from description.

In this Embodiment, the fixing unit 32 and the process cartridge 31 are held by the tray 35, detachably mountable to the image forming apparatus 3, so as to be disposed side by side with respect to the substantially horizontal direction. As shown in FIGS. 4, 5, 6(*a*) and 6(*b*), the process cartridge 31 is held by boss holding portions 36 (FIG. 6(*b*)) formed on the tray 35 through bosses 31*a* and 31*b* provided at side surfaces of the casing thereof. These bosses 31*a* and 31*b* and boss holding portions 36 are provided at both end portions with respect to the shaft direction of the photosensitive drum 10 (the direction perpendicular to the drawing sheet of FIGS. 4, 6(*a*) and 6(*b*)). Incidentally, in this embodiment, the case where the fixing unit 32 is fixed in the tray 35 will be described.

The tray 35 is provided with bosses 35*a* and 35*b* at side surfaces thereof. These bosses 35*a* and 35*b* are provided at both end portions with respect to the shaft direction of the photosensitive drum 10. On the other hand, in the image forming apparatus, a guide portion 34 for guiding the mounting and demounting of the tray 35 is provided. The guide portion 34 is provided at both end portions with respect to the shaft direction of the photosensitive drum 10. The guide portion 34 has a surface G extending in the substantially horizontal direction. In a state (at a position E) in which the tray 35 is mounted in the image forming apparatus 3, the surface G supports the bosses 35*a* and 35*b*, so that the tray 35 can be positioned in the image forming apparatus 3.

Incidentally, at a portion where the tray 35 opposes the conveying roller 8, an opening for permitting passing of the sheet material to be conveyed to the transfer nip by the conveying roller 8 is provided.

When the user accesses to the process cartridge 31, from the state shown in FIG. 4, the tray 35 is pulled out through the front surface of the image forming apparatus 3 (in the rightward direction in FIG. 4). In this case, the bosses 35*a* and 35*b* of the tray 35 are pulled out in the substantially horizontal direction while being slid on the surface G in the guide portion 34. FIG. 5 shows a state in which the tray 35 is pulled out from the image forming apparatus 3 in a direction indicated by an arrow D.

Thereafter, in a state (at a position F in FIGS. 6(*a*) and 6(*b*)) in which the tray 35 is pulled out from the image forming apparatus 3, the process cartridge 31 can be demounted from the tray 35. Incidentally, the tray 35 may also be provided with a holding portion 35*c* to be held by the user for mounting in and demounting from the image forming apparatus 3 through the front surface.

In this embodiment, similarly as in First Embodiment, the mounting and demounting of the process cartridge 31 can be performed by utilizing the space for permitting the mounting and demounting of the fixing unit 32, so that in order to mount and demount the process cartridge 31, there is no need to employ a constitution in which the upper surface of the image forming apparatus 3 is openable or a constitution in which the exposure device 9 is moved. That is, the conventional problem caused by access to the process cartridge from the upper surface can be solved while suppressing the height dimension of the image forming apparatus 3.

Further, in this embodiment, the process cartridge 31 is demounted in the state in which the tray 35 is pulled out, so that the process cartridge 31 can be demounted in a state in which a sufficient working space is ensured and thus operativity can be improved. Further, with less procedure, the user can access to the process cartridge 31. Further, the user can access to the process cartridge 31 without directly touching the fixing unit 32, so that even in the case where the fixing unit 32 is in a high-temperature state, an operation such as the jam clearance or the exchange of the process cartridge 31 can be performed.

Further, by the tray 35, the process cartridge 31 and the fixing unit 32 are integrally held, so that accuracy of alignment between the process cartridge 31 and the fixing unit 32 with respect to the height direction and the (tray 35) mounting and demounting direction for the image forming apparatus is improved. That is, a relative position between the fixing unit 32 and the process cartridge 31 with respect to the height and horizontal directions of the image forming apparatus is determined with reliability. Therefore, the sheet material P can be conveyed satisfactory, so than an image quality can be stabilized. Incidentally, in this embodiment, the fixing unit 32 is fixed in the tray 35 but similarly as in the case of the process cartridge 31, the fixing unit 32 may also be configured to be detachably mountable to the tray 35. In this case, a similar effect can be achieved. That is, at least the process cartridge 31 is only required to be detachably mountable to the tray 35.

Further, in this embodiment, the process cartridge 31 is demounted after the tray 35 is pulled out from the image forming apparatus main assembly to the position F but there is no need to pull out the tray 35 to the position F when the process cartridge 31 is located at a demountable position.

As described above, according to this embodiment, with respect to the image forming apparatus such that the fixing unit and the cartridge are mountable in and demountable from the apparatus main assembly, it is possible to provide the image forming apparatus in which the area of the opening surface for permitting the mounting and demounting of the fixing unit and the cartridge is suppressed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 165907/2009 filed Jul. 14, 2009, which is hereby incorporated by reference.

What is claimed is:

1. An image forming apparatus comprising:

a main assembly;

a cartridge, which is detachably mountable to said main assembly and includes a photosensitive member on which a toner image is to be formed, that operates so as to form the toner image on a sheet material in a state in which said cartridge is mounted in said main assembly; and a fixing unit, capable of retracting from a position inside said main assembly to a position outside said main assembly, for fixing the toner image on the sheet material at the position inside said main assembly, wherein when said fixing unit is retracted to the position outside said main assembly, said cartridge is demountable from said main assembly, wherein a cross-sectional area of said cartridge viewed from a mounting and demounting direction of said cartridge is smaller than that of said fixing unit, and wherein when said cartridge is demounted from said main assembly, said cartridge is demountable from said main assembly by passing a whole of said cartridge through a space to be occupied by said fixing unit.

2. The apparatus according to claim 1, wherein said cartridge is demountable from said main assembly in a demounting direction in which said fixing unit and said cartridge are arranged in said main assembly.

3. The apparatus according to claim 1, further comprising an opening that exposes an inside of said main assembly, wherein when said fixing unit is retracted from the position inside said main assembly to the position outside said main assembly, said fixing unit passes through said opening, and wherein when said cartridge is demounted from said main assembly, said cartridge passes through said opening.

4. The apparatus according to claim 1, further comprising:

a transfer member, contactable to the photosensitive member in a state in which said cartridge is mounted in said main assembly, that creates a transfer nip at which the toner image is to be transferred from the photosensitive member onto the sheet material, wherein said transfer member is disposed so that the transfer nip is positioned on an upstream side of a shaft of the photosensitive member with respect to a direction in which said cartridge is demounted from said main assembly when said cartridge is mounted in said main assembly.

5. An image forming apparatus comprising:

a main assembly;

a cartridge, which is detachably mountable to said main assembly and includes a photosensitive member on which a toner image is to be formed, that operates so as to form the toner image on a sheet material in a state in which said cartridge is mounted in said main assembly; and a fixing unit, completely detachably mountable to said main assembly, that fixes the toner image on the sheet material, wherein, when said cartridge is demounted from said main assembly, said cartridge passes through a space in which said fixing unit is to be mounted.

6. The apparatus according to claim 5, wherein said cartridge is demountable from said main assembly in a demounting direction in which said fixing unit and said cartridge are arranged in said main assembly.

7. The apparatus according to claim 5, further comprising an opening that exposes an inside of said main assembly, wherein when said fixing unit is demounted from said main assembly, said fixing unit passes through said opening, and wherein when said cartridge is demounted from said main assembly, said cartridge passes through said opening.

8. The apparatus according to claim 5, wherein said main assembly includes a first positioning portion, at which said fixing unit is to be positioned inside said main assembly in contact with the first positioning portion, and includes a second positioning portion at which said cartridge is to be positioned inside said main assembly in contact with the second positioning portion, and wherein the first positioning portion and the second positioning portion are formed on a common member.

9. The apparatus according to claim 5, further comprising:

a transfer member, contactable to the photosensitive member in a state in which said cartridge is mounted in said main assembly, that creates a transfer nip at which the toner image is to be transferred from the photosensitive member onto the sheet material, wherein said transfer member is disposed so that the transfer nip is positioned on an upstream side of a shaft of the photosensitive member with respect to a direction in which said cartridge is demounted from said main assembly when said cartridge is mounted in said main assembly.

10. An image forming apparatus comprising:

a main assembly;

a cartridge including a photosensitive member on which a toner image is to be formed, that operates so as to form the toner image on a sheet material;

a fixing unit that fixes the toner image on the sheet material; and a tray to which each of said cartridge and said fixing unit is detachably mountable, wherein said tray is movable between a first position where said tray is located in said main assembly and a second position where said tray is completely demounted from said main assembly, and wherein when said tray is located at the second position, each of said cartridge and said fixing unit is detachably mountable to said tray.

* * * * *